US007552798B2

(12) United States Patent
Swierski et al.

(10) Patent No.: US 7,552,798 B2
(45) Date of Patent: Jun. 30, 2009

(54) COLUMN CLIMBING DEVICE AND ASSOCIATED METHOD OF USE

(76) Inventors: Robert John Swierski, 2217 D Matthews Township Pkwy. #237, Matthews, NC (US) 28105; Thomas Joseph Swierski, 2217 D Matthews Township Pkwy. #237, Matthews, NC (US) 28105

( * ) Notice: Subject to any disclaimer, the term of this patent is extended or adjusted under 35 U.S.C. 154(b) by 92 days.

(21) Appl. No.: 11/114,970

(22) Filed: Apr. 26, 2005

(65) Prior Publication Data

US 2006/0080906 A1 Apr. 20, 2006

Related U.S. Application Data

(60) Provisional application No. 60/605,021, filed on Aug. 27, 2004.

(51) Int. Cl.
*A63B 27/00* (2006.01)

(52) U.S. Cl. ..... 182/134

(58) Field of Classification Search ..... 182/134–136, 182/221

See application file for complete search history.

(56) References Cited

U.S. PATENT DOCUMENTS 730,580 A * 6/1903 Stanford ..... 188/67
1,260,856 A * 3/1918 Bates ..... 182/134
1,312,399 A * 8/1919 Heywood ..... 182/134
2,021,433 A * 11/1935 Shaw ..... 182/134
2,082,553 A * 6/1937 Shaw et al. ..... 182/134
2,268,148 A * 12/1941 Hawkes ..... 182/134
3,004,622 A * 10/1961 Ringer ..... 182/134
3,019,852 A * 2/1962 Soderberg ..... 182/134
3,111,194 A 11/1963 Erwin
3,561,563 A * 2/1971 Harsh ..... 182/92
4,368,801 A 1/1983 Lewis
4,969,620 A * 11/1990 Plummer ..... 248/246
D324,130 S * 2/1992 Matsumoto et al. ..... D2/317
5,249,644 A * 10/1993 Amacker ..... 182/134
5,853,067 A * 12/1998 Cutler ..... 182/221

FOREIGN PATENT DOCUMENTS

FR 2624026 A1 * 6/1989

* cited by examiner

*Primary Examiner*—Alvin C Chin-Shue

(57) ABSTRACT

The present invention provides a column climbing device for climbing structural steel columns having flanges and the like. The column climbing device includes a platform member having a toe portion and a foot portion, the toe portion of the platform member including a first interior surface and a second interior surface together defining a substantially-rectangular notch open to one side of the toe portion of the platform member, the first interior surface and the second interior surface in a fixed parallel orientation with respect to one another, wherein the substantially-rectangular notch is configured to frictionally engage a flange of a column. The column climbing device also includes one or more attachment mechanisms attached to the foot portion of the platform member for securing the platform member to a foot of a user.

12 Claims, 4 Drawing Sheets

COLUMN CLIMBING DEVICE AND ASSOCIATED METHOD OF USE

CROSS-REFERENCE TO RELATED APPLICATION

The present non-provisional patent application claims the benefit of U.S. Provisional Patent Application No. 60/605,021, entitled "COLUMN CLIMBER FOR STRUCTURAL STEEL ERECTION," filed Aug. 27, 2004, which is herein incorporated in full by reference.

FIELD OF THE INVENTION

The present invention relates generally to the field of construction equipment. More specifically, the present invention relates to a column climbing device for climbing structural steel columns and the like and an associated method of use.

BACKGROUND OF THE INVENTION

During the construction process, especially the commercial or industrial construction process, after a foundation has been laid, a structural steel frame is erected to support various floor, wall, and roof systems. This structural steel frame erection process begins with the erection of a plurality of vertical structural steel columns, such as square columns or columns having flanges (I-columns) on the foundation. These vertical structural steel columns are joined together by a plurality of horizontal structural steel beams, such as girders or beams having flanges (I-beams). The vertical structural steel columns and horizontal structural steel beams are connected via bolts and/or welds to form vertical frames for the placement of wall systems and horizontal frames for the placement of floor and roof systems. At each level of the structure, it is necessary to access the tops of the vertical structural steel columns to position, bolt, and/or weld the horizontal structural steel beams to the columns.

Heretofore, the procedure for accessing the intermediate levels and tops of the vertical structural steel columns involved bracing a ladder against each column, using a personnel lift, or riding on one end of a horizontal structural steel beam supported by a crane cable. All of these procedures are marginally safe, inconvenient, and time consuming, and thus expensive. For example, using a ladder at ground level is, to some extent, acceptable from a safety standpoint. However, moving the ladder from vertical structural steel column to vertical structural steel column is inconvenient and time consuming, requiring a worker to adjust the feet of the ladder on uneven ground and often work from an unstable position. These problems are compounded at higher levels, where it is often necessary to balance the ladder on horizontal structural steel beams and move the ladder to subsequent vertical structural steel column locations by walking the horizontal structural steel beams while carrying the ladder. Personnel lifts are, in general, expensive to rent and operate and it can be expected that the ground at a construction site will be uneven, interspersed with plumbing and electrical stubs and various other obstructions that cause interference. In addition, operation of a personnel lift becomes obstructed to a greater degree at higher levels by intermediate-level horizontal structural steel beams, requiring up-and-down operation of the personnel lift bucket to move to subsequent vertical structural steel column locations. Finally, riding on one end of a horizontal structural steel beam supported by a crane cable is dangerous, unstable, awkward, and not conducive to horizontal structural steel beam alignment and placement. This procedure is no longer accepted in the present safety-conscious construction industry.

Alternative column climbing devices for climbing structural steel columns and the like, such as square columns and columns having flanges (I-columns), are known to those of ordinary skill in the art. A number of these column climbing devices are worn on the feet of a user, like a pair of climbing shoes. However, each of these column climbing devices suffers from at least one of a number of problems that makes the device difficult or impossible to use and, more importantly, inherently unsafe.

For example, U.S. Pat. No. 1,260,856 (issued to Bates on Mar. 26, 1918) discloses a climber for flanged metal poles consisting of a foot plate, means for securing said foot plate to the foot of a wearer, a member fixedly secured to said foot plate in the medial line thereof adjacent to the heel and offset from said medial line adjacent to the toe, said member having an upwardly and inwardly directed end carrying a point contact in the medial line of said foot plate to engage one side of the flange and means on said member spaced apart from said point contact to engage the other side of the flange.

This configuration makes the column climbing device difficult or impossible to use and inherently unsafe. Because a point contact is used to engage the back side of the flange of the beam, and all of the friction holding a user in place along the height of the beam is focused at this point contact, a dangerous fulcrum effect is created. Any rotational motion of the user's foot (which is inevitable and unavoidable while climbing and/or performing tasks) potentially disengages a portion of the line contact that is used to engage the front side of the flange of the beam, leaving only a point contact engaging the back side of the flange of the beam and a point contact engaging the front side of the flange of the beam. This is inherently unstable. In addition, the line contact that is used to engage the front side of the flange of the beam is subject to very high shear forces, making its failure more likely. Further, the column climbing device consists of a plurality of components, making its manufacture more difficult and, again, its failure more likely. Because this and other conventional column climbing devices are adjustable, via bolts or otherwise, it is difficult to maintain the relationship between the point contact and the line contact, for example, making these column climbing devices inherently dangerous.

Similarly, U.S. Pat. No. 1,312,399 (issued to Heywood on Aug. 5, 1919) discloses a column climbing device consisting of a body formed as a single casting and including a flat plate portion, a laterally-extending u-shaped yoke formed integrally upon one end of said plate portion, the upper edge of said yoke lying in the same plane as the upper surface of said plate portion, a pair of depending ears formed at the juncture of said yoke and said plate portion, a set screw threaded through the extremity of said yoke and extending towards said plate portion substantially in alignment with the longitudinal axis thereof, and a pair of set screws threaded through said ears and extending in a direction opposite to that of said first named set screw, said last named set screws being in a spaced-apart parallel relation to one another and to said first named set screw.

Again, this configuration makes the column climbing device difficult or impossible to use and inherently unsafe. Because a point contact is used to engage the back side of the flange of the beam, and all of the friction holding a user in place along the height of the beam is focused at this point contact, a dangerous fulcrum effect is created. Any rotational motion of the user's foot potentially disengages one of the two point contacts that are used to engage the front side of the flange of the beam, leaving only a point contact engaging the back side of the flange of the beam and a single point contact engaging the front side of the flange of the beam. This is inherently unstable. In addition, the column climbing device consists of a plurality of adjustable components, making its manufacture more difficult and its failure more likely.

U.S. Pat. No. 3,111,194 (issued to Erwin on Nov. 19, 1963) discloses a column climbing device consisting of an elongated rigid bar having a beveled inner end defining a biting edge, an elongated spacing member mounted on said bar, a first fastening means and a second fastening means detachably securing the spacing member to the bar, footwear engaging means attached to the first fastening means and the second fastening means and adapted to secure a climber to an item of footwear with the bar and spacing member disposed under the footwear sole and crosswise thereof and with said inner end protruding from an inner side of the footwear, said first fastening means being disposed adjacent to said inner end, a column binder including an inner leg, an outer leg, and an intermediate portion connecting corresponding ends of said legs and combining therewith to define a recess between said legs closed at one end by said intermediate portion and having an opposite open end, said inner leg being engaged by said first fastening means for securing the column binder immovably to said bar and spacing member, said outer leg having an inner biting edge disposed parallel to said biting edge of said bar and spaced outwardly and upwardly therefrom and adapted to engage an inner surface of a flange of a structural member the outer surface of which is engaged by the biting edge of the bar when the flange is received in said recess between said inner bar end and said outer leg.

Again, this configuration makes the column climbing device difficult or impossible to use and inherently unsafe. Because a line contact is used to engage the back side of the flange of the beam and a line contact is used to engage the front side of the flange of the beam, and because these line contacts are hinged and not disposed in a fixed parallel relationship to one another, a dangerous friction-release scenario is made possible. Any rotational motion of the user's foot potentially disengages a portion of the line contact that is used to engage the front side of the flange of the beam and/or the line contact that is used to engage the back side of the flange of the beam. This is inherently unstable. In addition, the hinge mechanism that structurally connects the line contact that is used to engage the front side of the flange of the beam to the line contact that is used to engage the back side of the flange of the beam is subject to very high shear forces, making its failure more likely. Further, the column climbing device consists of a plurality of components, making its manufacture more difficult and, again, its failure more likely. Still further, because, in this embodiment, a user's feet are next to a column being climbed, as opposed to in front of it, the user's center of gravity does nothing to maintain the line contacts described above and a dangerous twist-off scenario is made possible. A lever arm is created in the wrong direction.

U.S. Pat. No. 4,368,801 (issued to Lewis on Jan. 18, 1983) discloses a climbing device for climbing columns such as columns having flanges. The devices are worn in pairs on the feet of a climber and each is equipped with a gripping member having spaced-apart jaws adapted to grip the column flange. The gripping member on each device is mounted on the foot-attached or base member for selective swinging between two positions, one a climbing position in which each pair of jaws extends laterally-inwardly of the respective foot and the other a retracted position in which the jaws extend laterally-outwardly and behind the heel of the climber's foot so as to be out of the way when not used for climbing. Means are provided for selectively locking the gripping member to the base member in either of said positions.

Again, this configuration makes the column climbing device difficult or impossible to use and inherently unsafe. Because a plane contact is used to engage the back side of the flange of the beam and a plane contact is used to engage the front side of the flange of the beam, a dangerous friction-release scenario is made possible because the friction holding a user in place along the height of the beam is distributed over too large an area. This is inherently unstable and the user's weight is insufficient to provide enough friction force to hold the user in place along the height of the beam. In addition, the column climbing device consists of a plurality of components, making its manufacture more difficult and its failure more likely.

Therefore, what is needed is a column climbing device for climbing structural steel columns and the like that overcomes the problems described above. What is needed is a column climbing device that is relatively simple to use and inherently safe. What is also needed is a column climbing device that is relatively simple to manufacture and the failure of which is unlikely.

BRIEF SUMMARY OF THE INVENTION

In various embodiments, the present invention provides a column climbing device for climbing structural steel columns and the like that is relatively simple to use and inherently safe. The column climbing device allows a user to travel up and down structural steel columns and the like using natural motions by means of a platform member attached to each of the user's feet, the platform member capable of selectively gripping and releasing the structural steel columns and the like. This provides unparalleled access to the tops of the vertical structural steel columns to position, bolt, and/or weld horizontal structural steel beams. Advantageously, the column climbing device of the present invention is relatively simple to manufacture and its failure is almost inconceivable. The column climbing device provides a mobile, stable platform from which predetermined tasks may be accomplished in complete safety.

In one specific embodiment of the present invention, a column climbing device for climbing structural steel columns having flanges and the like includes a platform member having a toe portion and a foot portion, the toe portion of the platform member including a first interior surface and a second interior surface together defining a substantially-rectangular notch open to one side of the toe portion of the platform member, the first interior surface and the second interior surface in a fixed parallel orientation with respect to one another, wherein the substantially-rectangular notch is configured to frictionally engage a flange of a column. The column climbing device also includes one or more attachment mechanisms attached to the foot portion of the platform member for securing the platform member to a foot of a user.

In another specific embodiment of the present invention, a column climbing device for climbing structural steel columns and the like includes a platform member having a toe portion and a foot portion, the toe portion of the platform member including a first interior surface and a second interior surface together defining a substantially-rectangular notch open to one side of the toe portion of the platform member, the first interior surface and the second interior surface in an adjustable parallel orientation with respect to one another, wherein the substantially-rectangular notch is configured to frictionally engage a column. The column climbing device also includes one or more attachment mechanisms attached to the foot portion of the platform member for securing the platform member to a foot of a user.

In a further specific embodiment of the present invention, a method of using a column climbing device for climbing structural steel columns and the like includes providing a platform member having a toe portion and a foot portion, the toe portion of the platform member including a first interior surface and a second interior surface together defining a substantially-rectangular notch open to one side of the toe portion of the platform member, the first interior surface and the second interior surface in one of a fixed and adjustable parallel orientation with respect to one another, wherein the substantially-rectangular notch is configured to frictionally engage a column. The method of using the column climbing device also includes providing one or more attachment mechanisms attached to the foot portion of the platform member for securing the platform member to a foot of a user and securing the platform member to the foot of the user using the one or more attachment mechanisms. The method of using the column climbing device further includes disposing the substantially-rectangular notch about a portion of the column and selectively placing a portion of the body weight of the user on the platform member to frictionally engage the column.

BRIEF DESCRIPTION OF THE DRAWINGS

The present invention is illustrated and described herein with reference to various figures, in which like reference numbers denote like components and/or parts, and in which.

DETAILED DESCRIPTION OF THE INVENTION

In various embodiments, the present invention provides a column climbing device for climbing structural steel columns and the like that is relatively simple to use and inherently safe. The column climbing device allows a user to travel up and down structural steel columns and the like using natural motions by means of a platform member attached to each of the user's feet, the platform member capable of selectively gripping and releasing the structural steel columns and the like. This provides unparalleled access to the tops of the vertical structural steel columns to position, bolt, and/or weld horizontal structural steel beams. Advantageously, the column climbing device of the present invention is relatively simple to manufacture and its failure is unlikely.

Figure 1:
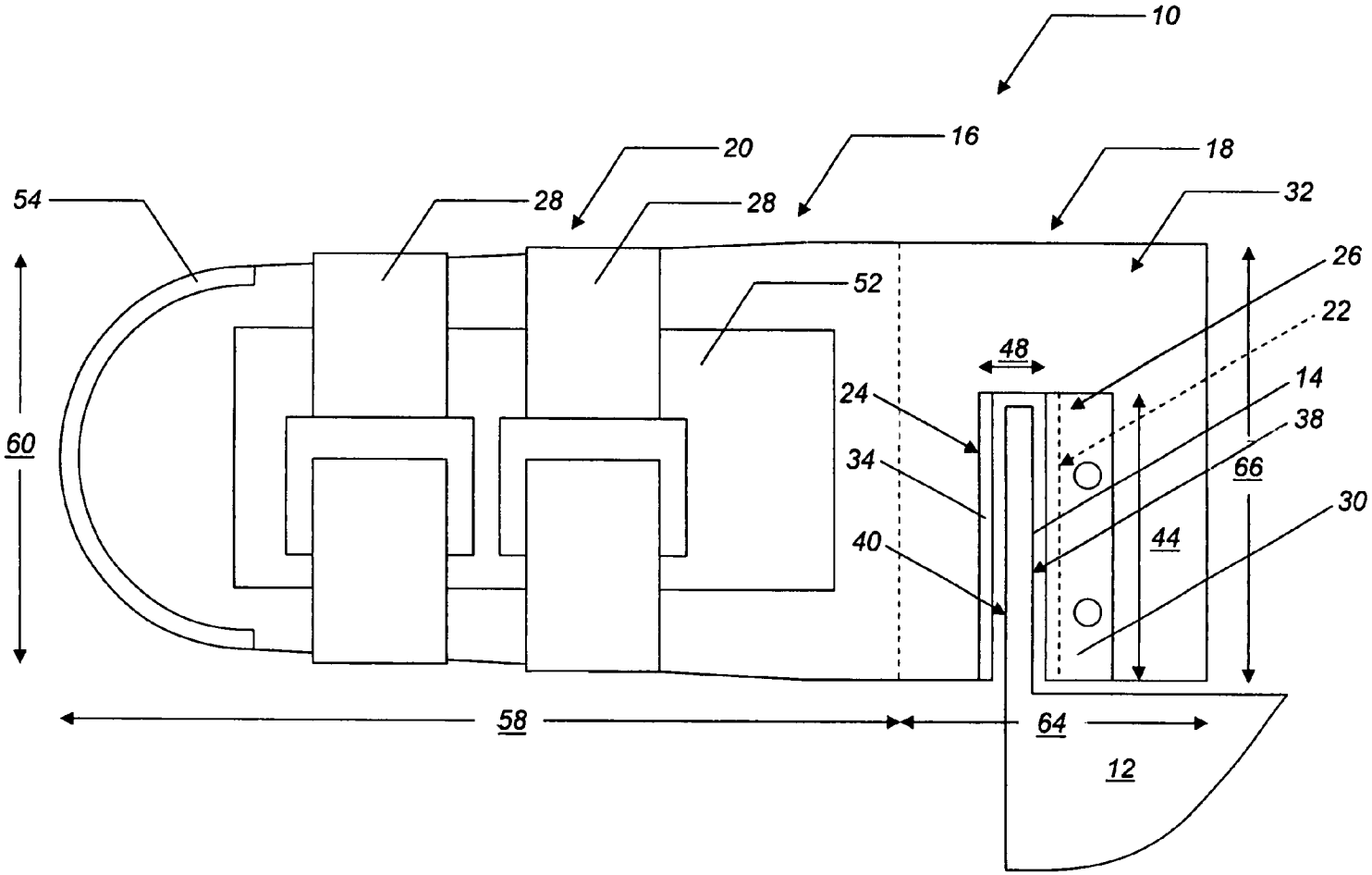
FIG. 1 is a top planar view of one specific embodiment of the column climbing device of the present invention.

Referring to FIG. 1, in one specific embodiment of the present invention, a column climbing device 10 for climbing structural steel columns 12 having flanges 14 and the like includes a platform member 16 having a toe portion 18 and a foot portion 20. Preferably, the toe portion 18 and the foot portion 20 of the platform member 16 are integrally formed. However, the toe portion 18 and the foot portion 20 of the platform member 16 may also be formed separately and joined via bolts and/or welds, etc. The toe portion 18 of the platform member 16 includes a first interior surface 22 and a second interior surface 24 together defining a substantially-rectangular notch 26 open to one side of the toe portion 18 of the platform member 16, the first interior surface 22 and the second interior surface 24 in a fixed parallel orientation with respect to one another. The substantially-rectangular notch 26 is configured to frictionally engage the flange 14 of the column 12. The column climbing device 10 also includes one or more attachment mechanisms 28 attached to the foot portion 20 of the platform member 16 for securing the platform member 16 to a foot of a user. The one or more attachment mechanisms 28 include, for example, one or more nylon or leather straps with buckles or the like. The one or more attachment mechanisms 28 may also be made of another substantially-flexible material.

The column climbing device 10 also includes a first hardened member 30 removably attached to at least a portion of the first interior surface 22 and a top surface 32 of the toe portion 18 of the platform member 16. The column climbing device 10 further includes a second hardened member 34 removably attached to at least a portion of the second interior surface 24 and a bottom surface 36 (FIGS. 2 and 3) of the toe portion 18 of the platform member 16. The first hardened member 30 and the second hardened member 34 are used (either singly or together) to selectively adjust the width 48 of the substantially-rectangular notch 26, with different sized first hardened members 30 and second hardened members 34 available for use. Preferably, the first hardened member 30 and the second hardened member 34 are substantially-angle-shaped and are attached to the toe portion 18 of the platform member 16 via one or more nuts and bolts or the like. The first hardened member 30 and the second hardened member 34 may be made of, for example, hardened steel or aluminum and provide a desired gripping effect with respect to the column 12. The first hardened member 30 and the second hardened member 34 may also be made of another suitable gripping material.

In operation, the first interior surface 22 of the toe portion 18 of the platform member 16 is configured to engage a back side 38 of the flange 14 of the column 12 along a first line of frictional force and the second interior surface 24 of the toe portion 18 of the platform member 16 is configured to engage a front side 40 of the flange 14 of the column 12 along a second line of frictional force.

Optionally, the toe portion 18 of the platform member 16 is inclined at a predetermined angle 42 (FIG. 2) with respect to the foot portion 20 of the platform member 16. Preferably, the toe portion 18 of the platform member 16 is inclined at an angle 42 of between about 15 degrees and about 45 degrees with respect to the foot portion 20 of the platform member 16. For example, the toe portion 18 of the platform member 16 may be inclined at an angle 42 of about 30 degrees with respect to the foot portion 20 of the platform member 16.

The first interior surface 22 and the second interior surface 24 together defining the substantially-rectangular notch 26 each have a width 44 of between about 2.5 inches and about 5.0 inches and a height 46 (FIG. 2) of between about 0.25 inches and about 0.50 inches. The first interior surface 22 and the second interior surface 24 together defining the substantially-rectangular notch 26 are separated by a distance 48 of between about 0.25 inches and about 0.75 inches.

Preferably, the platform member 16 is made of a material selected from the group consisting of steel, aluminum, another metal, another metal alloy, carbon fiber, a structural plastic, and any other material having suitable rigidity and strength. Optionally, the column climbing device 10 still further includes a reinforcing member 50 (FIGS. 2 and 3) fixedly attached to at least one of the top surface 32 and the bottom surface 36 of the toe portion 18 of the platform member 16 adjacent to at least a portion of the substantially-rectangular notch 26 defined by the first interior surface 22 and the second interior surface 24 of the toe portion 18 of the platform member 16. Optionally, the toe portion 18 and the foot portion 20 of the platform member 16 are made of different materials and then joined.

Finally, the column climbing device 10 may include an anti-slip layer 52 disposed adjacent to the top surface 32 of the foot portion 20 of the platform member 16, a heel stop 54 disposed adjacent to the top surface 32 of the foot portion 20 of the platform member 16, an anti-slip sole 56 (FIGS. 2 and 3) disposed adjacent to the bottom surface 36 of the foot portion 20 of the platform member 16.

In general, the foot portion 20 of the platform member 16 has a length 58 of between about 7.5 inches and about 15.0 inches, a width 60 of between about 4.0 inches and about 8.0 inches, and a thickness 62 (FIG. 2) of between about 0.25 inches and about 0.50 inches. The toe portion 18 of the platform member 16 has a length 64 of between about 2.0 inches and about 4.0 inches, a width 66 of between about 4.0 inches and about 8.0 inches, and a thickness 68 (FIG. 2) of between about 0.25 inches and about 0.50 inches. For example, in one exemplary embodiment of the present invention, the platform member 16 comprises a hot-rolled, 0.375-inch thick steel plate. Typically, the platform member 16 is formed by cutting, bending, extruding, stamping, forging, or any other suitable metal forming process, or by a molding process as would be the case with carbon fiber or a high-strength structural plastic.

It should be noted in the discussion above that a user preferably wears a left column climbing device on his or her left foot and a right column climbing device on his or her right foot, the left column climbing device and the right column climbing device comprising mirror images of one another and forming a column climbing device pair.

Figure 4:
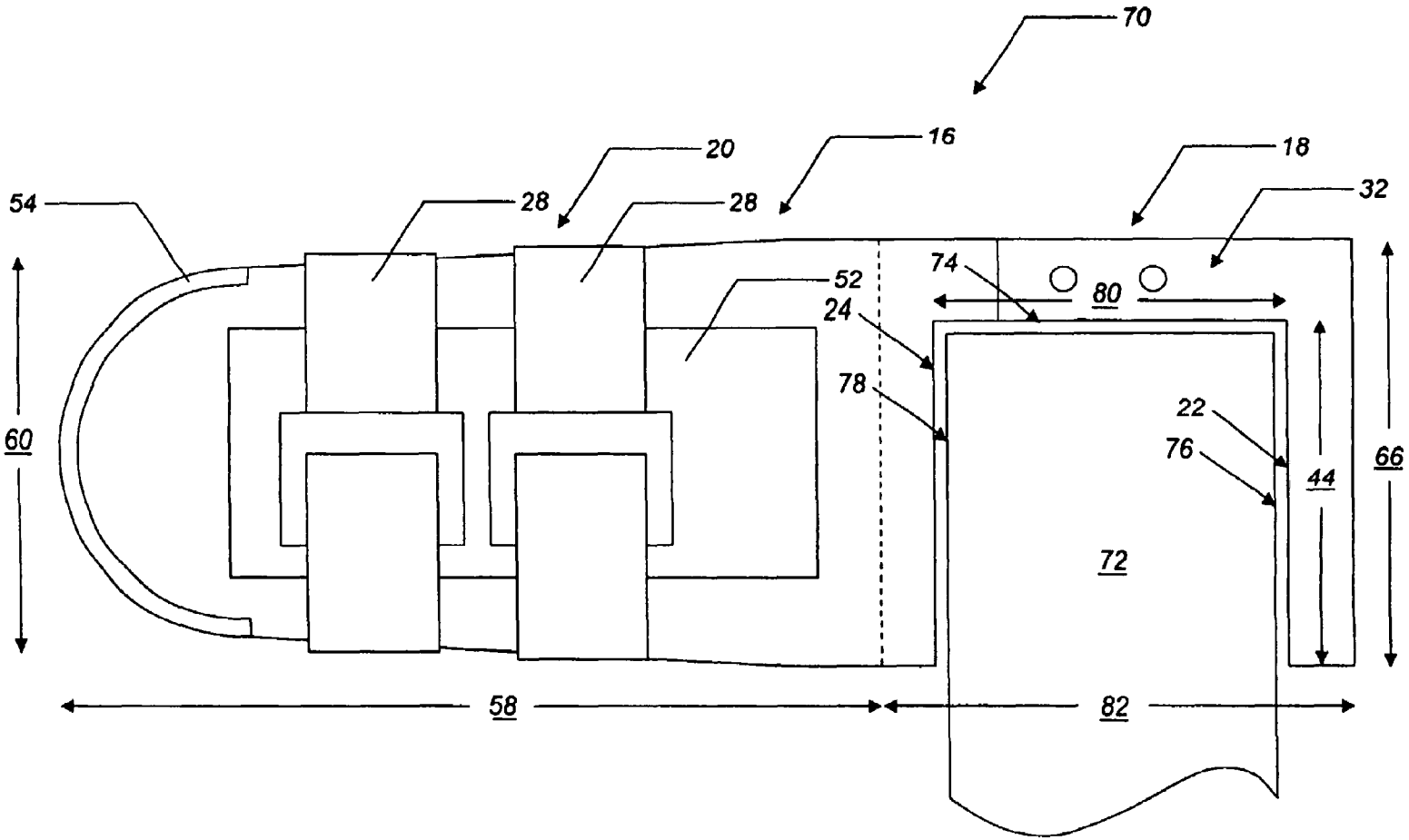
FIG. 4 is a top planar view of another specific embodiment of the column climbing device of the present invention.

Referring to FIG. 4, in another specific embodiment of the present invention, a column climbing device 70 for climbing structural steel columns 72 and the like includes a platform member 16 having a toe portion 18 and a foot portion 20. Preferably, the toe portion 18 and the foot portion 20 of the platform member 16 are integrally formed. However, the toe portion 18 and the foot portion 20 of the platform member 16 may also be formed separately and joined via bolts and/or welds, etc. The toe portion 18 of the platform member 16 includes a first interior surface 22 and a second interior surface 24 together defining a substantially-rectangular notch 74 open to one side of the toe portion 18 of the platform member 16, the first interior surface 22 and the second interior surface 24 in a selectively adjustable parallel orientation with respect to one another. The substantially-rectangular notch 74 is configured to frictionally engage the column 72. The column climbing device 70 also includes one or more attachment mechanisms 28 attached to the foot portion 20 of the platform member 16 for securing the platform member 16 to a foot of a user. The one or more attachment mechanisms 28 include, for example, one or more nylon or leather straps with buckles or the like.

In operation, the first interior surface 22 of the toe portion 18 of the platform member 16 is configured to engage a back side 76 of the column 72 along a first edge and first line of frictional force and the second interior surface 24 of the toe portion 18 of the platform member 16 is configured to engage a front side 78 of the column 12 along a second edge and second line of frictional force.

Figure 2:
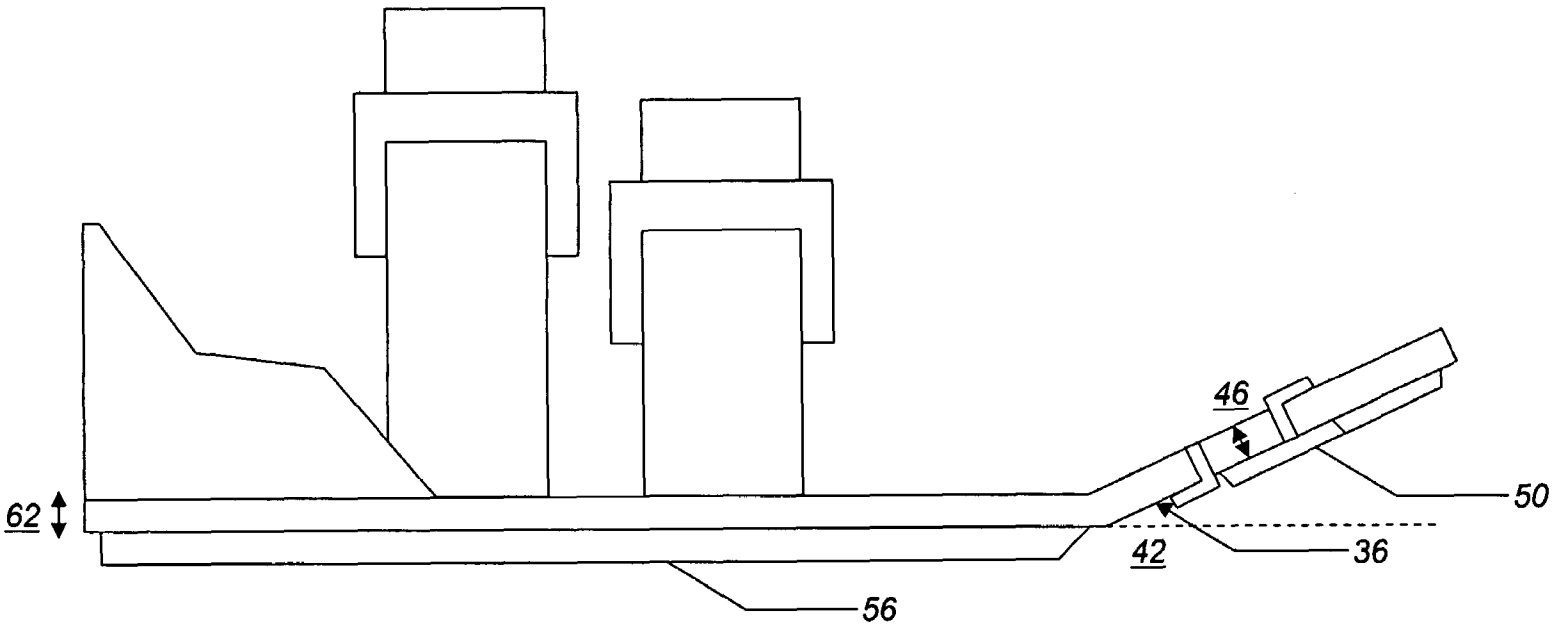
FIG. 2 is a side planar view of the column climbing device of FIG. 1.

Optionally, the toe portion 18 of the platform member 16 is inclined at a predetermined angle 42 (as illustrated in FIG. 2) with respect to the foot portion 20 of the platform member 16. Preferably, the toe portion 18 of the platform member 16 is inclined at an angle 42 of between about 15 degrees and about 45 degrees with respect to the foot portion 20 of the platform member 16. For example, the toe portion 18 of the platform member 16 may be inclined at an angle 42 of about 30 degrees with respect to the foot portion 20 of the platform member 16.

The first interior surface 22 and the second interior surface 24 together defining the substantially-rectangular notch 74 each have a width 44 of between about 2.5 inches and about 5.0 inches and a height 46 (as illustrated in FIG. 2) of between about 0.25 inches and about 0.50 inches. The first interior surface 22 and the second interior surface 24 together defining the substantially-rectangular notch 74 are selectively separated by a distance 80 of between about 0.25 inches and about 6.00 inches.

Preferably, the platform member 16 is made of a material selected from the group consisting of steel, aluminum, another metal, another metal alloy, carbon fiber, a structural plastic, and any other material having suitable rigidity and strength. Optionally, the column climbing device 70 still further includes a reinforcing member 50 (as illustrated in FIGS. 2 and 3) fixedly attached to at least one of the top surface 32 and the bottom surface 36 (as illustrated in FIGS. 2 and 3) of the toe portion 18 of the platform member 16 adjacent to at least a portion of the substantially-rectangular notch 74 defined by the first interior surface 22 and the second interior surface 24 of the toe portion 18 of the platform member 16.

Figure 3:
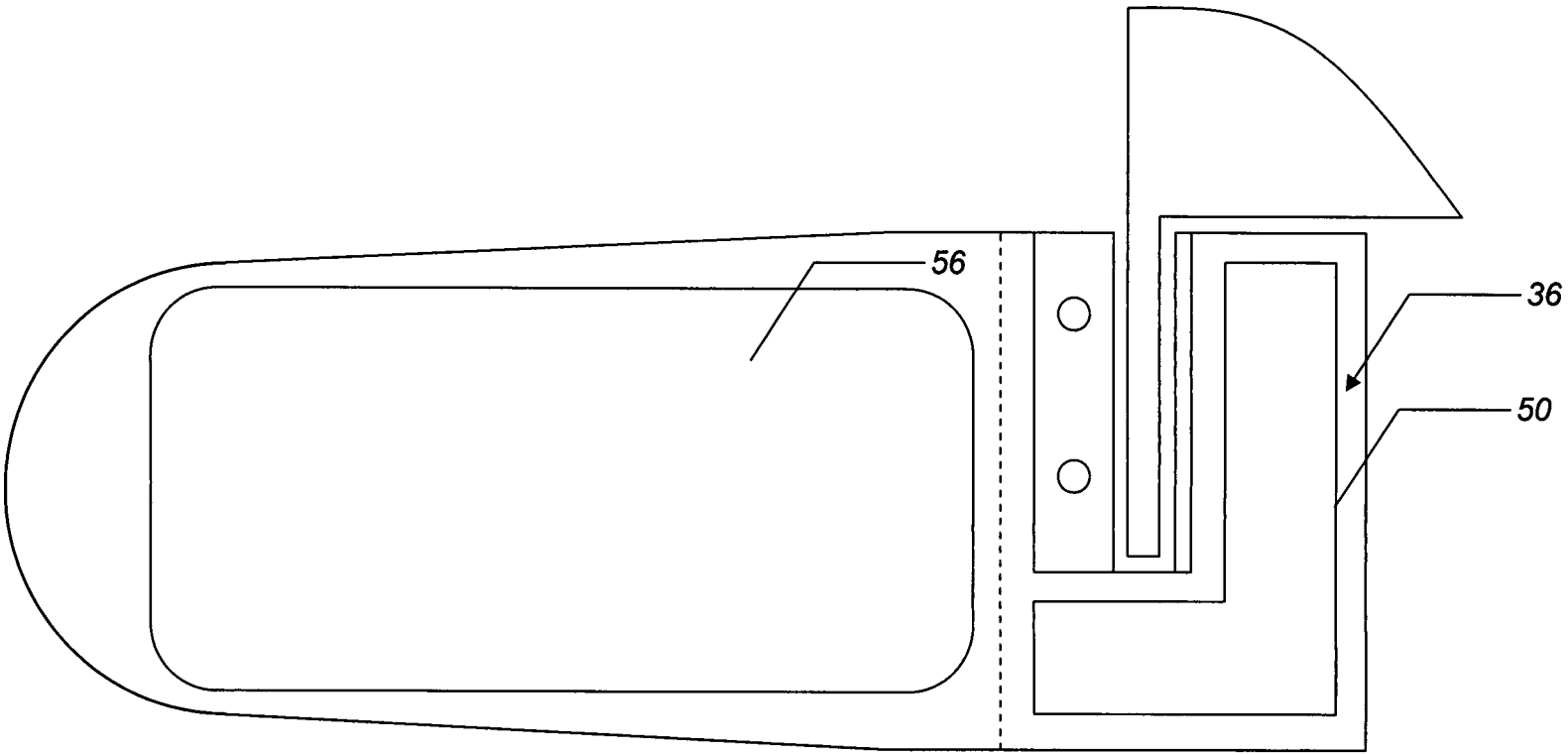
FIG. 3 is a bottom planar of the column climbing device of FIGS. 1 and 2.

Finally, the column climbing device 70 may include an anti-slip layer 52 disposed adjacent to the top surface 32 of the foot portion 20 of the platform member 16, a heel stop 54 disposed adjacent to the top surface 32 of the foot portion 20 of the platform member 16, an anti-slip sole 56 (as illustrated in FIGS. 2 and 3) disposed adjacent to the bottom surface 36 of the foot portion 20 of the platform member 16.

In general, the foot portion 20 of the platform member 16 has a length 58 of between about 7.5 inches and about 15.0 inches, a width 60 of between about 4.0 inches and about 8.0 inches, and a thickness 62 (as illustrated in FIG. 2) of between about 0.25 inches and about 0.50 inches. The toe portion 18 of the platform member 16 has a length 82 of between about 2.0 inches and about 10.0 inches, a width 66 of between about 4.0 inches and about 8.0 inches, and a thickness 68 (as illustrated in FIG. 2) of between about 0.25 inches and about 0.50 inches. For example, in one exemplary embodiment of the present invention, the platform member 16 comprises a hot-rolled, 0.375-inch thick steel plate. Typically, the platform member 16 is formed by cutting, bending, extruding, stamping, forging, or any other suitable metal forming process, or by a molding process as would be the case with carbon fiber or a high-strength structural plastic.

Again, it should be noted in the discussion above that a user preferably wears a left column climbing device on his or her left foot and a right column climbing device on his or her right foot, the left column climbing device and the right column climbing device comprising mirror images of one another and forming a column climbing device pair.

In operation, a user selects the appropriate column climbing device from a pair of column climbing devices for each of the left and right foot. The appropriate column climbing device is selected based upon the location of the substantially-rectangular notch. The left-foot column climbing device will have substantially-rectangular notch open to the right side of the platform member and the right-foot column climbing device will have the substantially-rectangular notch open to the left side of the platform member. The user places his or her foot on the foot portion of the platform member, with the heel of his or her foot against the heel stop, and secures the one or more attachment mechanisms to his or her foot. The user then approaches the base of a structural steel column or the like and places his or her safety strap, well known to those of ordinary skill in the art, around the base of the column. The column is grasped with both hands for balance as the user's left or right foot is raised between about 8.0 and about 12.0 inches. The substantially-rectangular notch open to the corresponding side of the platform member of the raised column climbing device is then disposed about the appropriate flange of the column, or the side of the column itself, whereupon the user's foot is tilted back slightly and the user's body weight is placed fully upon the platform member. This provides the column climbing device with a secure locking grip. The process is repeated with the other foot, and so on, allowing the user to, in a substantially-upright position, climb the column. The safety strap is moved incrementally upwards during the ascent. This process is reversed for a descent.

Although the present invention has been illustrated and described with reference to preferred embodiments and examples thereof, it will be readily apparent to those of ordinary skill in the art that other embodiments and examples may perform similar functions and/or achieve similar results. All such equivalent embodiments and examples are within the spirit and scope of the invention and are intended to be covered by the following claims.

What is claimed is:

1. A column climbing device for climbing structural steel columns having flanges and the like, comprising:

a platform member having a planar toe portion and a planar foot portion, the planar foot portion of the platform member adapted to receive a foot of a user, the planar toe portion of the platform member extending only forward from the planar foot portion substantially co-axial with the length of the planar foot portion and comprising a first metallic interior surface and a second metallic interior surface positioned within the platform member together defining a substantially-rectangular notch open to one side of the planar toe portion of the platform member and substantially perpendicular to the length of the planar foot portion, the first metallic interior surface and the second metallic interior surface in a fixed parallel orientation with respect to one another and having substantially-equal dimensions, wherein the substantially-rectangular notch is only forward of the planar foot portion and is configured to frictionally engage a flange of a column, the first metallic interior surface of the planar toe portion of the platform member is configured to engage a back side of the flange of the column along a first edge and first line of frictional force and the second metallic interior surface of the planar toe portion of the platform member is configured to engage a front side of the flange of the column along a second edge and second line of frictional force;

a first hardened member removably and immovably in contact with at least a portion of a top surface of the toe portion of the platform member, but not also in contact with a portion of a bottom surface of the toe portion of the platform member, wherein the first hardened member is substantially co-extensive with the first metallic interior surface of the substantially-rectangular notch;

wherein the first metallic interior surface of the planar toe portion of the platform member selectively engages the back side of the flange of the column along the first edge and first line of frictional force associated with the first hardened member;

wherein the second metallic interior surface of the planar toe portion of the platform member selectively engages the front side of the flange of the column along the second edge and second line of frictional force;

wherein the first line of frictional force is in a parallel spaced-apart relationship with the first metallic interior surface of the planar toe portion of the platform member and the second line of frictional force; and wherein the first line of frictional force and the second line of frictional force are substantially equal in dimensions; and one or more attachment mechanisms attached to the planar foot portion of the platform member for securing the platform member to the foot of the user, further comprising a second hardened member removably and immovably in contact with at least a portion of the bottom surface of the toe portion of the platform member, but not also in contact with a portion of the top surface of the toe portion of the platform member, wherein the second hardened member is substantially co-extensive with the second metallic interior surface of the substantially-rectangular notch; wherein the second metallic interior surface of the planar toe portion of the platform member selectively engages the front side of the flange of the column along the second edge and second line of friction force associated with the second hardened member; and wherein the second line of friction force is in a parallel spaced-apart relationship with the second metallic interior surface of the planar toe portion of the platform member and the first line of friction force, the planar toe portion of the platform member is inclined at a predetermined angle with respect to the planar foot portion of the platform member.

2. The column climbing device of claim 1, further comprising the first hardened member removably attached to at least a portion of the first metallic interior surface and the top surface of the toe portion of the platform member.

3. The column climbing device of claim 1, wherein the planar toe portion of the platform member is inclined at an angle of between about 15 degrees and about 45 degrees with respect to the planar foot portion of the platform member.

4. The column climbing device of claim 1, wherein the first metallic interior surface and the second metallic interior surface together defining the substantially-rectangular notch each have a width of between about 2.5 inches and about 5.0 inches and a height of between about 0.25 inches and about 0.50 inches.

5. The column climbing device of claim 1, wherein the first metallic interior surface and the second metallic interior surface together defining the substantially-rectangular notch are separated by a distance of between about 0.25 inches and about 0.75 inches.

6. The column climbing device of claim 1, wherein the platform member comprises a material selected from the group consisting of steel, aluminum, another metal, another metal alloy, carbon fiber, and a structural plastic.

7. The column climbing device of claim 1, further comprising a reinforcing member fixedly attached to at least one of a top surface and the bottom surface of the planar toe portion of the platform member adjacent to at least a portion of the substantially-rectangular notch defined by the first interior surface and the second interior surface of the planar toe portion of the platform member.

8. The column climbing device of claim 1, further comprising an anti-slip layer disposed adjacent to a top surface of the planar foot portion of the platform member.

9. The column climbing device of claim 1, further comprising a heel stop disposed adjacent to a top surface of the planar foot portion of the platform member.

10. The column climbing device of claim 1, further comprising an anti-slip sole disposed adjacent to a bottom surface of the planar foot portion of the platform member.

11. The column climbing device of claim 1, wherein the planar foot portion of the platform member has a length of between about 7.5 inches and about 15.0 inches, a width of between about 4.0 inches and about 8.0 inches, and a thickness of between about 0.25 inches and about 0.50 inches.

12. The column climbing device of claim 1, wherein the planar toe portion of the platform member has a length of between about 2.0 inches and about 4.0 inches, a width of between about 4.0 inches and about 8.0 inches, and a thickness of between about 0.25 inches and about 0.50 inches.

* * * * *